United States Patent [19]

Lindner et al.

[11] 4,444,110

[45] Apr. 24, 1984

[54] ARRANGEMENT FOR GENERATING A FIRING SIGNAL FOR OVERFLIGHT-FLYING BODIES

[75] Inventors: Friedrich Lindner; Dietmar Stützle, both of Lauf; Nikolaus Argyrakis, Nuremberg, all of Fed. Rep. of Germany

[73] Assignee: Diehl GmbH & Co., Nuremberg, Fed. Rep. of Germany

[21] Appl. No.: 381,896

[22] Filed: May 25, 1982

[30] Foreign Application Priority Data

Jun. 4, 1981 [DE] Fed. Rep. of Germany ..... 3122252

[51] Int. Cl.[3] ..... F42C 13/02

[52] U.S. Cl. ..... 102/213

[58] Field of Search ..... 102/213, 214, 211

[56] References Cited

U.S. PATENT DOCUMENTS

| | | | |
|---|---|---|---|
| 3,242,339 | 3/1966 | Lee | 102/213 |
| 4,098,191 | 7/1978 | Bagwell et al. | 102/213 |
| 4,242,962 | 1/1981 | Wakeman et al. | 102/213 |

*Primary Examiner*—Charles T. Jordan

*Attorney, Agent, or Firm*—Scully, Scott, Murphy & Presser

[57] ABSTRACT

An arrangement for generating a firing or triggering signal for a projectile which is conveyed in a flying body overflying a target, wherein a target identifying circuit requires a processing period for the identification of a detected target pursuant to predetermined characteristics, and in which, subsequent to a waiting period dependent upon the flying altitude, there occurs a delay or lag period between the initiation of the firing signal and the ejection or, respectively, target impact of the projectile. For the target determination, an optical sensor arrangement is directed at a first acute angle relative to the flight trajectory of the flying body; wth this angle being so calculated that at a minimum flying altitude of the flying altitude of the flying body, the flying time from the target determination up to the overflight of a certical above the target is at least equal to the sum of the processing period and the delay or lag period, and in which the sensor arrangement is set a second acute angle which is larger than the first angle after the identification of a selected target, and which takes into consideration the delay period and the flying altitude.

4 Claims, 4 Drawing Figures

ARRANGEMENT FOR GENERATING A FIRING SIGNAL FOR OVERFLIGHT-FLYING BODIES

BACKGROUND OF THE INVENTION

1. Field of the Invention

The present invention relates to an arrangement for generating a firing or triggering signal for a projectile which is conveyed in a flying body overflying a target, wherein a target identifying circuit requires a processing period for the identification of a detected target pursuant to predetermined characteristics, and in which, subsequent to a waiting period dependent upon the flying altitude, there occurs a delay or lag period between the initiation of the firing signal and the ejection or, respectively, target impact of the projectile.

2. Discussion of the Prior Art

The classification of a target pursuant to a predetermined criteria sets forth a procedure which even for electronic circuits requires a processing period which is not negligible when the identification of target is carried out during the target approach of the flying body. At the direct determination of the firing timepoint during the target identification, there is obtained an unsatisfactory target hit image.

SUMMARY OF THE INVENTION

Accordingly, it is an object of the present invention to provide an arrangement of the above mentioned type, in which the determination of the firing timepoint is independent of the time of the target identification.

The foregoing object is inventively achieved in that for the target determination, an optical sensor arrangement is directed at a first acute angle relative to the flight trajectory of the flying body; with this angle being so calculated that at a minimum flying altitude of the flying body, the flying time from the target determination up to the overflight of a vertical above the target is at least equal to the sum of the processing period and the delay or lag period, and in which the sensor arrangement is set at a second acute angle which is larger than the first angle after the identification of a selected target, and which takes into consideration the delay period and the flying altitude. Alternatively, a second sensor arrangement is set at a second angle which correlates with the delay period and a correcting time period which dependent upon the altitude and in which, when required, the firing signal is initiated subsequent to the correcting time period when the identified target is located below this second angle. During approach to the target there is initially detected a target which is located under the first acute angle. This target is thereafter identified, which will require a processing period. When a selected target is identified, there then follows an altitude-dependent waiting time period. Thereafter, when the target appears below the second acute angle, the firing signal is triggered so that, after the passing of an ammunition-dependent delay or lag period, the projectile is ejected in the direction of the target. The flight time of the projectile from the flying body to the target can be neglected in a first approximation since the flying velocity of the projectile is substantially higher than that of the flying body. However, it can also be taken into consideration in the delay or lag time period. The projectile hits from above against the target. An assured target hit position is given in that after target identification the firing signal is only triggered when the target stands below the above-mentioned second angle. This second angle is independent of the duration of the time for target identification.

BRIEF DESCRIPTION OF THE DRAWINGS

Advantageous embodiments of the invention may now be ascertained from the following detailed description as set forth hereinbelow, taken in conjunction with the accompanying drawings; in which.

DETAILED DESCRIPTION

Figure 1:
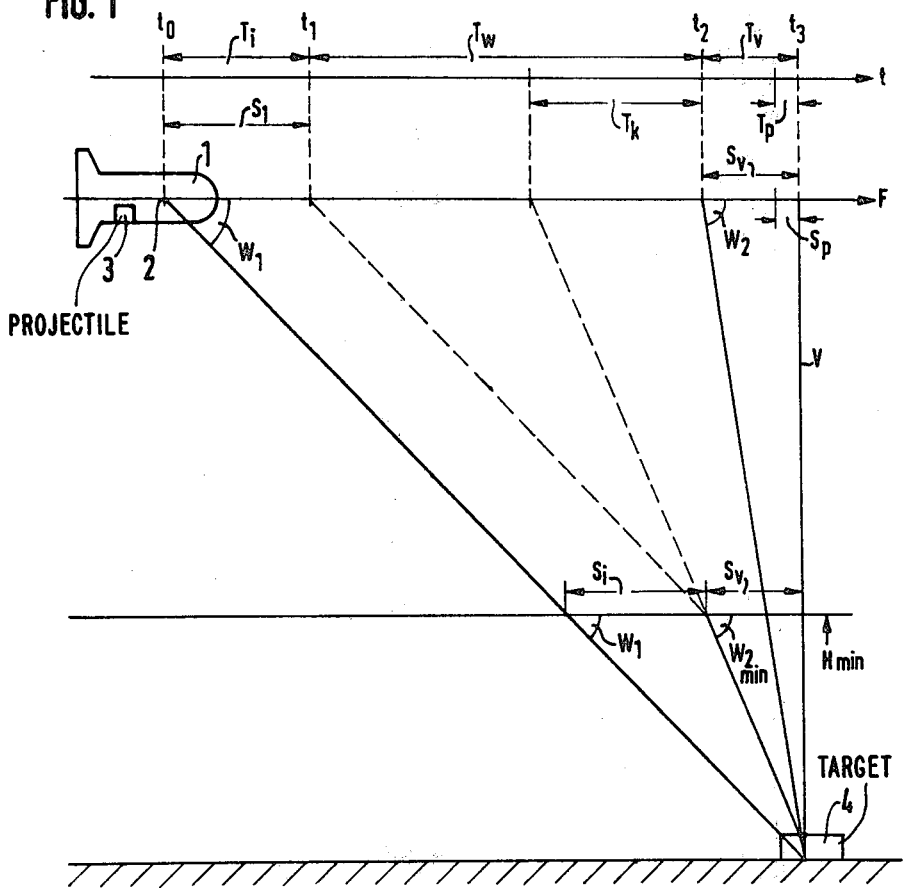
FIG. 1 illustrates a diagrammatic representation of spatial-time relationships within a target range.
Figure 3:
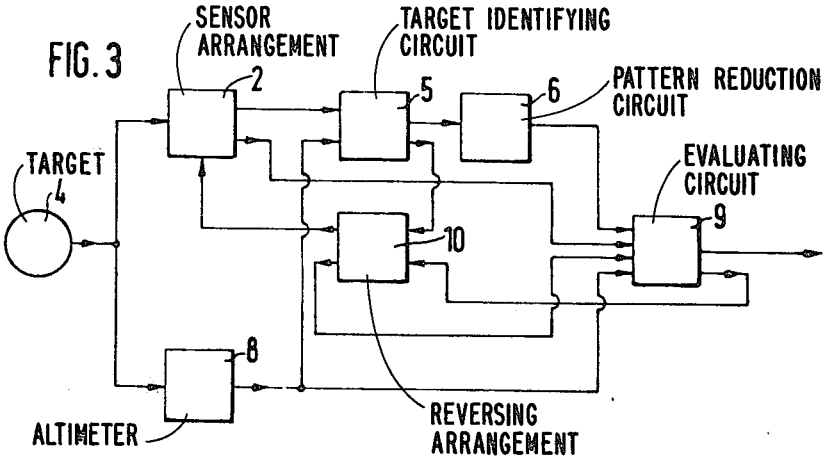
FIG. 3 is a schematic block diagram of a further embodiment of the firing installation.
Figure 4:
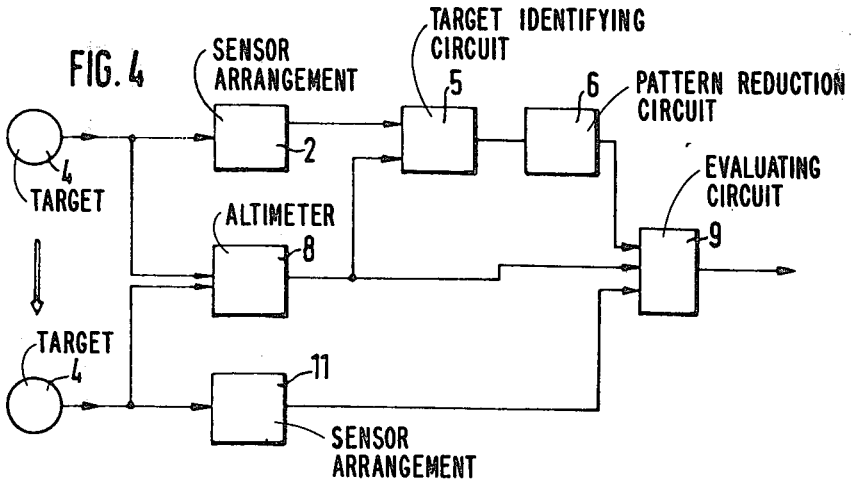
FIG. 4 is a schematic block diagram of a third embodiment of the firing installation.

The flying body 1 includes a sensor arrangement 2 consisting of an optical system and a detector, and carries one or more projectiles 3. In FIG. 1, the flying body 1 flies in a trajectory or flight path 1 above a ground target 4. The vertical relative to the target 4 is designated by V. The projectile 3 should be fired so that it will hit from above against the target 4. The flying body 1, for this purpose, incorporates installations as shown in FIGS. 2, 3 or 4 for the initiation or triggering of a firing signal for the projectile 3.

Figure 2:
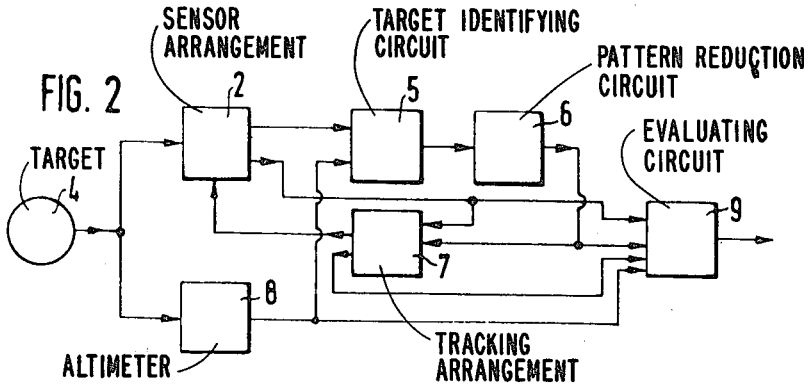
FIG. 2 is a schematic block diagram of a firing installation.

In the installation pursuant to FIG. 2, the sensor arrangement 2 includes a detector cell or a plurality of detectors cells (focal-plane-detector-array). The output of the sensor arrangement 2 is connected to a target identifying circuit 5. In this circuit there are stored the criteria which are characteristic of a target which is to be attacked. The signals of the individual elements of the sensor arrangement 2 are compared with these data, for example, in accordance with intensity surges and the number and arrangement of signal-conducting individual elements For effectuating the comparison between the received signals and the stored data, the target identifying circuit 5 requires a processing period Ti. During this period Ti the flying body 1 has traversed a distance Si.

Connected to the output of the target identifying circuit 5 is a pattern reduction circuit 6. Through the intermediary of this last-mentioned circuit, the complex pattern representation at the output of the circuit 5 is converted into a simplified signal pattern. This signal pattern controls a tracking arrangement 7 (tracker) which will so vary the angular position of the sensor arrangement 2 that this, or the optical system thereof, is tracked after the detected target 4.

The installation includes an altimeter 8 which determines the altitude of the flight path above the ground. The result of the altitude measurement is conveyed to the target identifying circuit 5. Thereafter, a predetermined target 4 will represent itself on the sensor arrangement 2 through a pattern which is dependent upon the flying altitude. The altimeter 8 further has an evaluating circuit 9 connected thereto. In this evaluating circuit, from the altitude and the firing lag period Tv, which is a constant of the firing sequence effecting the ejection of the projectile, there is then obtained an angle W2 (refer to FIG. 1). Connected to the inputs of the evaluating circuit 9 besides the sensor arrangement 2, are pattern reduction circuit 6 and the tracking arrangement 7. The output signal provides the firing impulse for the projectile 3.

The sensor arrangement 2, at the beginning of the flight, is directed at an angle W1 relative to the flight path. The angle W1 is determined with consideration being given to the following criteria:

The processing time period Ti and the firing delay or lag time period Tv can be considered as being constants. The projectile 3 is ejected at the earliest after the passage of these time periods, possibly, with consideration being given to its flying speed which, however, in the first approximation thereof, is negligible. In accordance therewith, the target detection must be carried out over the distance Si+Sv ahead of the vertical V above the target. This should also be afforded at a minimum altitude Hmin. Obtained hereby is the angle W1 (refer to FIG. 1).

The mode of operation of the installation illustrated in FIG. 2 is generally as follows:

As soon as the target 4 is located below the angle W1 relative to the flight path F. target identification commences at t0. This is terminated at t1. When the detected target 4 is a selected target, then the tracking arrangement 7 receives the command from the circuit 6 to transmit to the sensor the pattern of this target. The altimeter 8 provides the current flying altitude, the evaluating circuit 9 the angle W2, whereupon a firing signal should be emitted when the target 4 stands below the angle W2 relative to the flight path F. As soon as the tracking arrangement 7 has adjusted the sensor arrangement from the angle W1 to the angle W2, there is effected the firing. For purpose of safety, the sensor arrangement 2 and the circuit 6 are so connected to the evaluating circuit 9 that the firing at the current angle W2 will only take place when the sensor arrangement 2 detects a target 4 and this conforms to the pattern of the selected target.

The firing signal is initiated at timepoint t2. Between the timepoint t1 and the timepoint t2 there is a waiting time period Tw which is dependent on altitude.

Should there be considered the flying time of the projectile, then the current angle W2 can be corrected in the evaluating circuit 9 in dependence of the current flying altitude and the known flying speed of the projectile 3 with consideration being given to the distance Sp which results from the flying time Tp of the projectile 3 from the flying body 1 to the target 4.

In the embodiment pursuant to FIG. 3, in lieu of the tracking arrangement 7 there is provided a reversing arrangement 10 which pivots the sensor arrangement 2 from the angle W1 into the angle W2. The reversing arrangement 10 is controlled by an evaluating circuit 9 which is modified with respect to that of FIG. 2, which calculates the angle W2 from the firing lag time period Tv and the flying altitude, into which the sensor is to be pivoted after the recognition of the selected target. Connected to the reversing arrangement 10 is also the target identifying circuit 5, so that a switching command for pivoting into the angle W2 becomes effective only upon a completed target recognition.

As in FIG. 2, the evaluating circuit 9 in FIG. 3 is, on the one hand, coupled directly and, on the other hand, through the circuits 5 and 6 to the sensor arrangement 2. Moreover, it receives from the reversing arrangement 10 a signal after the effectuated movement of the sensor within the time period Tw from the angle W1 into the angle W2. It emits the firing signal as soon as the target 4 is located below the angle W2, and when there is present the pattern of the selected target.

Additionally, the altimeter 8 is connected with the evaluating circuit 9. Herewith there can be undertaken a correlation of the firing timepoint with the flying altitude, for example, in order to consider the flying time Tp of the projectile 3.

For the remainder, the foregoing installation is identical to that disclosed and described with respect to FIG. 2.

In the embodiments pursuant to FIGS. 2 and 3, mechanical arrangements are required for changing of the positioned angle of the sensor arrangement 2, or in essence, its optical system. In the embodiment according to FIG. 4, in lieu thereof there is provided a second sensor arrangement 11. This can be constructed from an additional detector scanning cell. However, for the second sensor arrangement 11 there can also be utilized a detector scanning cell of the sensor arrangement 2, when it is provided with its own optical system. The second sensor arrangement 11 is positioned at a fixed angle W2. This will eliminate the altitude-dependent correcting capability of the angle W2. The second sensor arrangement 11 is set at the angle W2 min. (refer to FIG. 1). Hereby, at altitudes above Hmin. the firing signal will initiate itself prematurely. In order to avoid this condition, the evaluating circuit 9 calculates from the current flight altitude a corrective time period Tk which is dependent upon the flying altitude (refer to FIG. 1). As in the embodiment pursuant to FIG. 2, in the evaluating circuit 9 there is also considered the firing lag period Tv.

The firing signal t2 is initiated when the pattern of the selected target is recognized, the angle W2 min. is overflown, and the corrective time period Tk has passed. After passage of the firing delay or lag time period Tv, the projectile 3 is ejected.

For the remainder, also this embodiment corresponds to that described with respect to FIG. 2 of the drawings.

While there has been shown and described what are considered to be preferred embodiments of the invention, it should be understood that variations in form and detail could readily be made without departing from the spirit of the invention. It is therefore intended that the invention be not limited to the exact form and detail shown herein and described, nor to anything other than the whole of the invention as hereinafter claimed.

We claim:

1. In an arrangement for the generating of a firing signal for a projectile conveyed in a flying body overflying a target, including a target identifying circuit requiring a processing time period for the identification of a detected target pursuant to predetermined characteristics, and wherein after a waiting time period dependent upon the flying altitude there occurs a lag time between the initiation of the firing signal and the ejection of target impact of the projectile; the improvement comprising: optical sensor means for target detection being arranged at a first acute angle relative to the flight path of the flying body, said angle being measured so that at a minimum flying altitude of the flying body the flying time from target detection to overflight of a vertical from the target is at least equal to the sum of the processing time period and lag time; means for positioning said sensor means upon identification of a selected target at a second acute angle which is larger than the first angle and takes into consideration the lag time, said second angle conforming to the lag time and an altitude-dependent corrective time, and said firing signal being triggered after the corrective time period when said identified target is below said second angle.

2. Arrangement as claimed in claim 1, comprising means for having said sensing means track said selected target after identification thereof, and calculating said second angle from the flying altitude and the lag time, and triggering said firing signal when said sensor means is tacked within said second angle.

3. Arrangement as claimed in claim 1, comprising means for pivoting said sensor means into the current angle determined after identification of a selected target from the flying altitude and the lag time, and wherein said firing signal is triggered when said selected target is below said second angle.

4. Arrangement as claimed in claim 1, comprising a second sensor means at a fixed second angle in consideration of the lag time, said firing signal being triggered upon passing of a corrective time period during passage over the target by said second sensor means.

* * * * *